United States Patent [19]

Finnhult

[11] 4,375,706

[45] Mar. 8, 1983

[54] BED BOTTOM

[75] Inventor: Carl-Axel Finnhult, Liatorp, Sweden

[73] Assignee: Landstingens Inkopscentral, Lic, Ekonomisk Forening, Solna, Sweden

[21] Appl. No.: 212,338

[22] Filed: Dec. 2, 1980

[30] Foreign Application Priority Data

Dec. 4, 1979 [SE] Sweden ..... 7910000

[51] Int. Cl.[3] ..... A61G 7/00

[52] U.S. Cl. ..... 5/61

[58] Field of Search ..... 5/60, 61, 66–68

[56] References Cited

U.S. PATENT DOCUMENTS

| | | | |
|---|---|---|---|
| 882,641 | 3/1908 | Joslin | 5/60 |
| 1,677,218 | 7/1928 | Shand . | |
| 2,522,018 | 9/1950 | Blackman . | |
| 2,690,177 | 9/1959 | Hogan | 5/61 |
| 3,127,783 | 4/1964 | Martens | 5/68 |
| 3,304,116 | 2/1967 | Stryker | 5/86 |
| 4,006,499 | 2/1977 | Young | 5/66 |
| 4,084,274 | 4/1978 | Willis et al. | 5/61 |

FOREIGN PATENT DOCUMENTS

| | | | |
|---|---|---|---|
| 359837 | 3/1962 | Switzerland | 5/61 |

*Primary Examiner*—Francis K. Zugel
*Assistant Examiner*—Michael F. Trettel
*Attorney, Agent, or Firm*—Cushman, Darby & Cushman

[57] ABSTRACT

A bed bottom is divided into a middle section and two side sections pivotably attached to the middle section at their edges. The middle section is pivotable about a longitudinal central axis with the aid of a control means into different desired angular positions. The outer side edges of the side sections are carried by the upper ends of links distributed along the length of the side sections and pivotably mounted at their lower ends on the bed frame.

2 Claims, 4 Drawing Figures

BED BOTTOM

Figure 1:
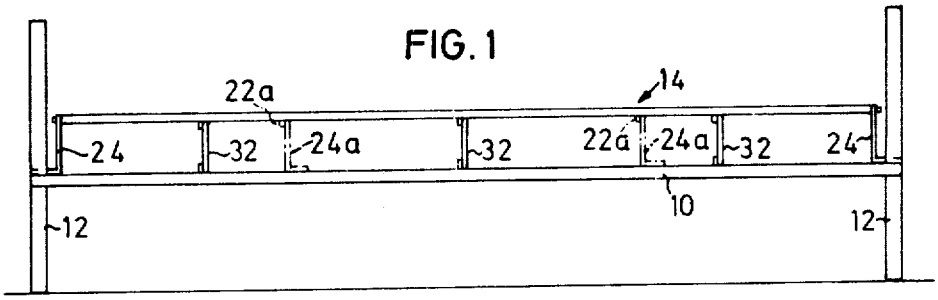

The present invention relates to bed bottoms which are divided up in a longitudinal middle section and two longitudinal side sections, e.g. for carrying a mattress with a patient lying on it, the middle section being mounted on the bed frame for pivoting about a longitudinal axis at the centre of the middle section and the side sections being articulatedly connected to the middle section, each side section being pivotably mounted for pivoting about a longitudinal axis at the side edges of the middle section for enabling different angular positions of the middle section and side sections in relation to each other. Each side section is thereby carried at a further pivot axis with journaling means on the bed frame allowing transverse displacement of this pivot axis when the middle section is turned in one or the other direction from its horizontal intermediate position with the aid of a control means simultaneously as the side sections follow this movement by the side section adjacent the side edge of the middle section which is swung downwards being lowered along its inner side edge and positioned at an angle.

Such an arrangement is known from the Swedish Pat. No. 7610240-9 and is intended for disabled patients. Since the middle section can be angularly positioned in one or the other direction, the patient can be rolled over more or less to one or the other side to avoid bed sores. This alteration in the patient's position on the bed can also be utilized to facilitate looking after the patient.

In the known arrangement there are two fixed guide rails disposed at the respective end of the bed. The middle section of the bed bottom is pivotable about a longitudinal central shaft journalled at its ends in bearings at the rails. The side sections are partially carried by the middle section by means of the articulated connections thereto and partially by longitudinal shafts arranged at the outer edges of the side sections and being guided at their ends in the horizontal guide rails. When the middle section is set in a horizontal position, the side sections are also horizontal. However, the middle section can be set at different angular positions from one or the other side with the aid of a control means, the inner edges of the side sections following this setting. On the other hand, the outer edges of the side sections will remain at the same height as the guide rails since their ends are guided in the guide rails.

In the known bed bottom the outer edge of the side sections rests on the respective pivot shaft, the ends of which are pivotably and displaceably mounted in the guide rails. This pivot shaft is however without any support between its ends and must therefore be dimensioned extremely heavily to support a person sitting on the bed edge without said shaft being deflected too much. If the outer frame tube of the respective side section is allowed to replace the through-going pivot shaft, and the ends of the respective side section are provided with gliding stub shafts guided in the rails, the frame tube must be dimensioned to carry the sitting person and will then be so heavily dimensioned that such dimensions cannot be accepted.

It has furthermore been found that in practice a rather heavy slope of the side sections is desired even for a relatively small slope of the middle section. This heavy slope is not obtained when the pivoting axis of the side sections is at their outer side edge. To obtain a heavier slope, the pivot axis must be moved inwards so that it will lie closer to the axis of articulation between the side sections and the middle section, the side edge tube of the respective side section thus being without intermediate support and must thus be dimensioned so heavily that it can resist bending for the load of a person sitting on the edge of the bed. What would be required is thus to apply one or more points of support between the ends of the side sections to avoid bending, while the dimensions of the side section frame and pivot shaft could be kept within reasonable limits. However, it has been found that arranging such support points in the known bed bottom results in considerable problems.

The object of the invention is therefore to provide an improvement of the known bed bottom so that with simple means the desired number of support points can be arranged along the outer edge of the respective side section, simultaneously as there is enabled, using simple means, the selection of a desired angular setting of the side sections for a given angular setting of the middle section.

This is achieved with a bed bottom which, in accordance with the invention, has the characterizing features disclosed in the following claims.

A suitable embodiment of a bed bottom in accordance with the invention is schematically illustrated on the appended drawing.

Figure 2:
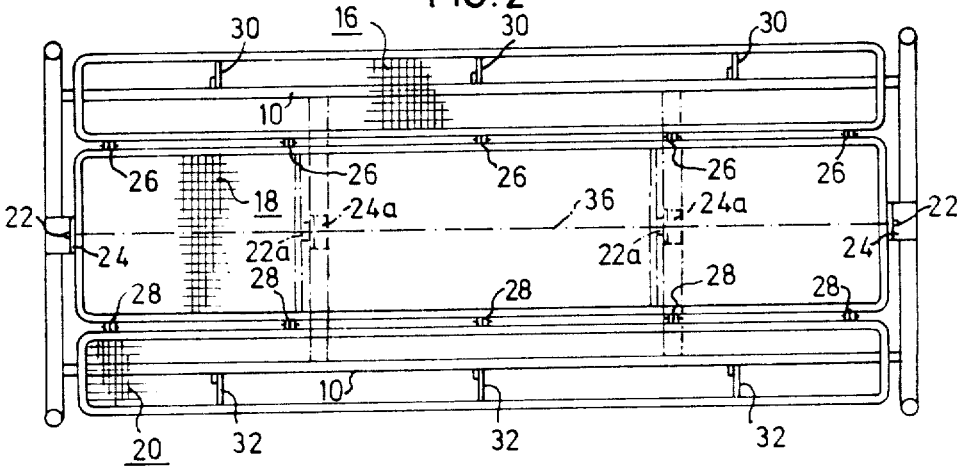
Figure 3:
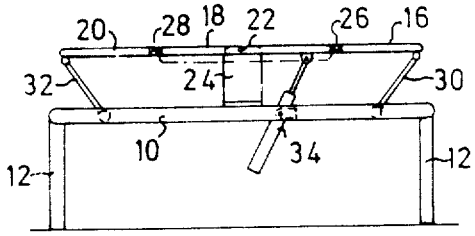
Figure 4:
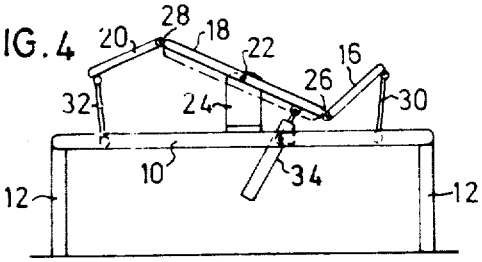

FIG. 1 is a schematic side view of a bed with a bed bottom in accordance with the invention, FIG. 2 is a view from above, FIG. 3 is an end view of the bed bottom in a flat position, and FIG. 4 is an end view of the bed bottom in an angular position to one side.

The bed comprises a bed frame 10 with legs 12 for carrying a sectioned bed bottom 14 on which there is normally a mattress which is not shown. The bed bottom comprises a middle section 18 and two side sections 16,20 articulatedly connected thereto.

The middle section conventionally comprises a frame to which is attached a supporting lattice bottom. In the same way, each of the side sections consists of a frame with a lattice bottom attached to it, as is indicated in FIG. 2.

At its ends, the middle section is mounted on stub shafts 22 carried by posts 24 to provide a longitudinal pivot axis at the centre of the middle section.

The side sections 16,20 are articulatedly connected to the side edges of the middle section by means of joints 26,28 at their inner side edges.

At their outer side edges, the side sections are connected to the upper ends of three links 30 and 32, respectively, which are distributed along the length of the respective side section and which have their lower ends pivotably connected to the bed frame 10.

As is apparent from FIG. 3, the links slope upwards and outwards when the middle section and the side sections are horizontal and in level with each other.

With the aid of a control means 34, the middle section 18 can be pivoted towards one or the other side, as is indicated in FIG. 4. At the same time one side section 16 is turned downwards while the other side section 20 is turned upwards.

By selecting the length of the links greater or smaller, a higher or lower degree of slope of the side section 16 or 20 can be obtained in a simple way for a certain angular position of the middle section 18. If the slope of the respective side section 16 or 20 is chosen to be relatively heavy, the respective side section will function as an effective barrier preventing the patient from falling off from the bed when the middle section is inclined to one or the other side.

The control of the slope of the side sections in response to the slope of the middle section with the aid of the links 30,32 results in that the ends of the bed bottoms will be free from the ends of the bed frame, which can thus carry removable bed ends in a simple way, if so required.

The number of links along the length of the side sections can be selected according to need, so that the outer edges of the side sections will be sufficiently supported to be able to carry a person sitting down from one side of one of the side sections. The frames of the side sections thus do not need to be dimensioned so heavily as is the case when the outer side edges of the side sections have no intermediate support in the way apparent from the known arrangement.

The above-described simple embodiment may be varied within the scope of the invention. The legs 12 may be omitted and the bed frame 10 may advantageously be supported by a known wheel-supported base frame including lifting means for raising and lowering the bed frame 10 to any desired height. At least one of the posts 24 with its stub shaft 22 for pivotably mounting the middle section may be replaced by preferably two posts 24*a* located at spaced places along the centre line 36 of the middle section and supported by the bed frame 10 and connected with the middle section by means of pivot joints 22*a*. This gives good support of the middle section and enables keeping at least one end of the bed bottom 14 free, which is advantageous when the bed frame is supported to be raised and lowered and, also, possibly tiltable about a horizontal axis.

In previous bed frames the bed bottom is surrounded by a rigid upper frame connected to the bed frame. This upper frame is uncomfortable both for the patient and the nurse. According to the invention, this upper frame can be omitted.

What I claim is:

1. A bed bottom which is divided into a longitudinal middle section and two longitudinal side sections, e.g. for carrying a mattress with a person lying on it, the middle section being mounted for pivoting about a longitudinal axis at the centre of the middle section and each of the side sections being articulatedly connected along its inner side edge to the middle section for pivoting about a longitudinal axis at the side edge of the middle section, so that the middle section can be set at different angular positions with the aid of a control means simultaneously as the side sections accomodate this movement by their being pivotally joined to a bed frame, characterized in that each side section is connected at its outer side edge portion to one end of each of a number of links distributed along the outer side edge of the respective side section, and that the other end of each of the links is pivotably connected to the bed frame, the arrangement being such that when the middle section and the side sections are in one and the same horizontal position, the links extend slopingly upwards and outwards to their articulated connections at the outer side edge portions of the side sections.

2. A bed comprising a horizontal frame; a bed bottom disposed above the frame, the bed bottom including a longitudinal middle section having a planar portion for supporting a person's body and two longitudinal side sections, each having a planar portion; means mounting the middle section for pivotal movement relative to the frame about a longitudinal axis at the center of the middle section; means pivotally connecting the inner side edge of the planar portion of each side section to an edge of the planar portion of the center section for pivotal movement about a longitudinal axis parallel to the axis of the side section; a plurality of links arranged along the longitudinal dimension of each side section, each link having an upper end pivotally connected to the outer side edge portion of the respective side section for pivotal movement about a longitudinal axis parallel to said axis of said center section and each link having a lower end pivotally connected to the frame for pivotal movement about a longitudinal axis parallel to said axis of said center section, said links being arranged to slope upwardly and outwardly when said middle section and said side sections are in one and the same horizontal position and said links permitting said side sections to tilt relative to said horizontal plane when said center section pivots about its longitudinal center axis.

* * * * *